US009999298B1

(12) United States Patent
Sullins

(10) Patent No.: US 9,999,298 B1
(45) Date of Patent: Jun. 19, 2018

(54) LAP DESK WITH MOUSE PAD AND DEVICE SLOT

(71) Applicant: Patrick Hogan Sullins, Arlington, TX (US)

(72) Inventor: Patrick Hogan Sullins, Arlington, TX (US)

( * ) Notice: Subject to any disclaimer, the term of this patent is extended or adjusted under 35 U.S.C. 154(b) by 0 days. days.

(21) Appl. No.: 15/635,197

(22) Filed: Jun. 28, 2017

Related U.S. Application Data

(60) Provisional application No. 62/355,447, filed on Jun. 28, 2016.

(51) Int. Cl.

| | |
|---|---|
| ***A47B 23/06*** | (2006.01) |
| ***A47B 23/00*** | (2006.01) |
| ***A47B 21/04*** | (2006.01) |
| ***A47B 13/16*** | (2006.01) |

(52) U.S. Cl.
CPC ..... *A47B 23/06* (2013.01); *A47B 13/16* (2013.01); *A47B 21/04* (2013.01); *A47B 23/002* (2013.01)

(58) Field of Classification Search
CPC ..... A47B 23/06; A47B 13/16; A47B 21/04; A47B 23/002
USPC ..... 428/99, 100; 248/345.1, 346.01, 346.03, 248/346.04, 346.11; 108/25, 26, 90, 43, 108/27
See application file for complete search history.

(56) References Cited

U.S. PATENT DOCUMENTS

D400,924 S * 11/1998 Cornell ..... D14/458
5,937,765 A * 8/1999 Stirling ..... A47B 23/002 108/43
6,177,165 B1 * 1/2001 Robbins, III ..... A47G 27/0206 248/346.01
6,264,156 B1 * 7/2001 Yeh ..... A47B 23/06 248/346.01
6,491,275 B1 * 12/2002 Goodman ..... B32B 5/18 248/346.01
7,269,002 B1 * 9/2007 Turner ..... G06F 1/1632 29/592.1
7,275,724 B1 * 10/2007 Ward ..... A47B 23/002 108/43
8,667,904 B2 * 3/2014 Pajic ..... A47B 23/00 108/25
D766,228 S * 9/2016 Haymond ..... D14/252
(Continued)

FOREIGN PATENT DOCUMENTS

DE 202013101241 * 1/2013
GB 2513933 * 11/2014

*Primary Examiner* — Janet M Wilkens
(74) *Attorney, Agent, or Firm* — Guy V. Manning

(57) ABSTRACT

A lap desk includes within its planar work surface a mouse pad and a slotted port for securing an electronic device such as a tablet, e-reader or cellular telephone in an upright and useable position. The mouse pad is substantially flush with the work surface and disposed in a right hand or left hand position for right- or left-handed users. The slotted port is inclined slightly so that the user can view and engage the device's screen while working with other objects on the lap desk. The slotted port may vary in width for electronic devices of various sizes; its depth and thickness accommodating most hand-held electronic devices without obscuring their screens. In one embodiment, the mouse pad and slotted port are molded into a module bearing a flange which can be inserted into a congruently sized aperture in any surface.

12 Claims, 6 Drawing Sheets

(56) References Cited

U.S. PATENT DOCUMENTS

| | | | | |
|---|---|---|---|---|
| 9,501,096 | B2 * | 11/2016 | Sharma | G06F 1/1632 |
| 9,701,234 | B2 * | 7/2017 | Pajic | A47B 23/00 |
| 2004/0261668 | A1 * | 12/2004 | Jarke | B82Y 30/00 108/43 |
| 2006/0148564 | A1 * | 7/2006 | Herkelman | A63F 13/06 463/37 |
| 2010/0320349 | A1 * | 12/2010 | Necessary | F16M 11/10 248/346.03 |
| 2013/0134282 | A1 * | 5/2013 | Negretti | A47B 23/04 248/450 |
| 2014/0070061 | A1 * | 3/2014 | Tsai | A47D 1/008 248/205.1 |
| 2015/0340892 | A1 * | 11/2015 | Schreiner | H02J 7/0044 320/137 |
| 2016/0286953 | A1 * | 10/2016 | Castro | A47B 23/04 |

* cited by examiner

LAP DESK WITH MOUSE PAD AND DEVICE SLOT

This application claims priority from Provisional Application Ser. No. 62/355,447 filed Jun. 28, 2016.

BACKGROUND OF THE INVENTION

1. Field of the Invention

This invention relates generally to lap desks and particularly to lap desks adapted for use with hand-held electronic devices. More particularly, this invention relates to a lap desk having built into its work surface a mouse pad and a slotted port for holding upright said electronic device. Still more particularly, this invention relates to a mouse pad and slotted port module which may be applied to any planar surface.

2. Description of Related Art

Lap desks commonly comprise planar, rigid, often rectangular, portable work platforms adapted to rest in a user's lap and to support books, writing pads, electronic devices or the like. Lap desks also commonly include padding on their bottom sides to enhance user comfort while the weight of the lap desk and objects bears upon the user's lap. While using multiple objects together, such as a writing pad and an electronic device, the lap desk work surface can become somewhat crowded. Increasing the work surface area has practical limits imposed by the size is the user's lap or the seat in which the user rests. Means for more efficient use of lap desk work surface space would mitigate such problems.

Recently developed electronic devices such as tablet computers, game machine controllers and cellular telephones are comparatively thin in cross section. They seldom come equipped with stands or props for holding them upright, however, causing them to occupy a disproportionate share of the lap desk work surface. A lap desk with a slot adapted to cradle an edge of such an electronic device and hold it upright would retain the electronic device on the work surface without consuming substantial lap desk work surface space.

Lap desks often also are used with laptop computers employing a separate, movable pointing device such as a mouse. A computer mouse detects horizontal movement and translates it to movement of an indicator icon on the laptop screen. It does so using either a roller ball or a laser light beam extending downward from the bottom of the mouse toward a resting surface. The roller ball must engage a surface having sufficient friction to turn the ball, a trait the relatively smooth, hard finish of most work surfaces, including lap desks, usually lacks. The laser must point toward an opaque surface which minimizes unnecessary light scatter. In either case, users commonly carry a separate mouse pad which must be stored separately and often can become lost or damaged. A lap desk with a built in mouse pad would relieve users of the burden of providing and keeping track of a separate mouse pad.

Medium density fibreboard (MDF) is an engineered wood product made from hardwood or softwood fibers combined with wax and a resin binder by applying high temperature and pressure to form panels. It is stronger and much denser than particle board, and makes a durable panel for lap desks. MDF also often is covered in PVC to harden its planar surface for some applications, including lap desks. MDF is, however, difficult to cut smoothly for slots and holes, and PVC cannot easily be folded smoothly into a cutout in the MDF. A need exists for an insert bearing a flange which can smooth out irregularities in slots cut into MDF, and which can secure the edges of PVC coatings on MDF. Such module also can be used to insert a slot and mouse pad into any planar surface.

SUMMARY OF THE INVENTION

A lap desk includes within its planar work surface a mouse pad and a slotted port for securing an electronic device such as a tablet, e-reader or cellular telephone in an upright and useable position. The mouse pad is substantially flush with the work surface and disposed in a right hand or left hand position for right- or left-handed users. The slotted port is inclined slightly so that the user can view and engage the device's screen while working with other objects on the lap desk. The slotted port may vary in width for electronic devices of various sizes; its depth and thickness accommodating most hand-held electronic devices without obscuring their screens. In one embodiment, the mouse pad and slotted port are molded into a module bearing a flange which can be inserted into a congruently sized aperture in any surface.

BRIEF DESCRIPTION OF THE DRAWINGS

The novel features believed characteristic of the present invention may be set forth in appended claims. The invention itself, as well as a preferred mode of use and further objects and advantages thereof, will best be understood by reference to the following detailed description of an illustrative embodiment when read in conjunction with the accompanying drawings, wherein:

DESCRIPTION OF A PREFERRED EMBODIMENT

Figure 1:
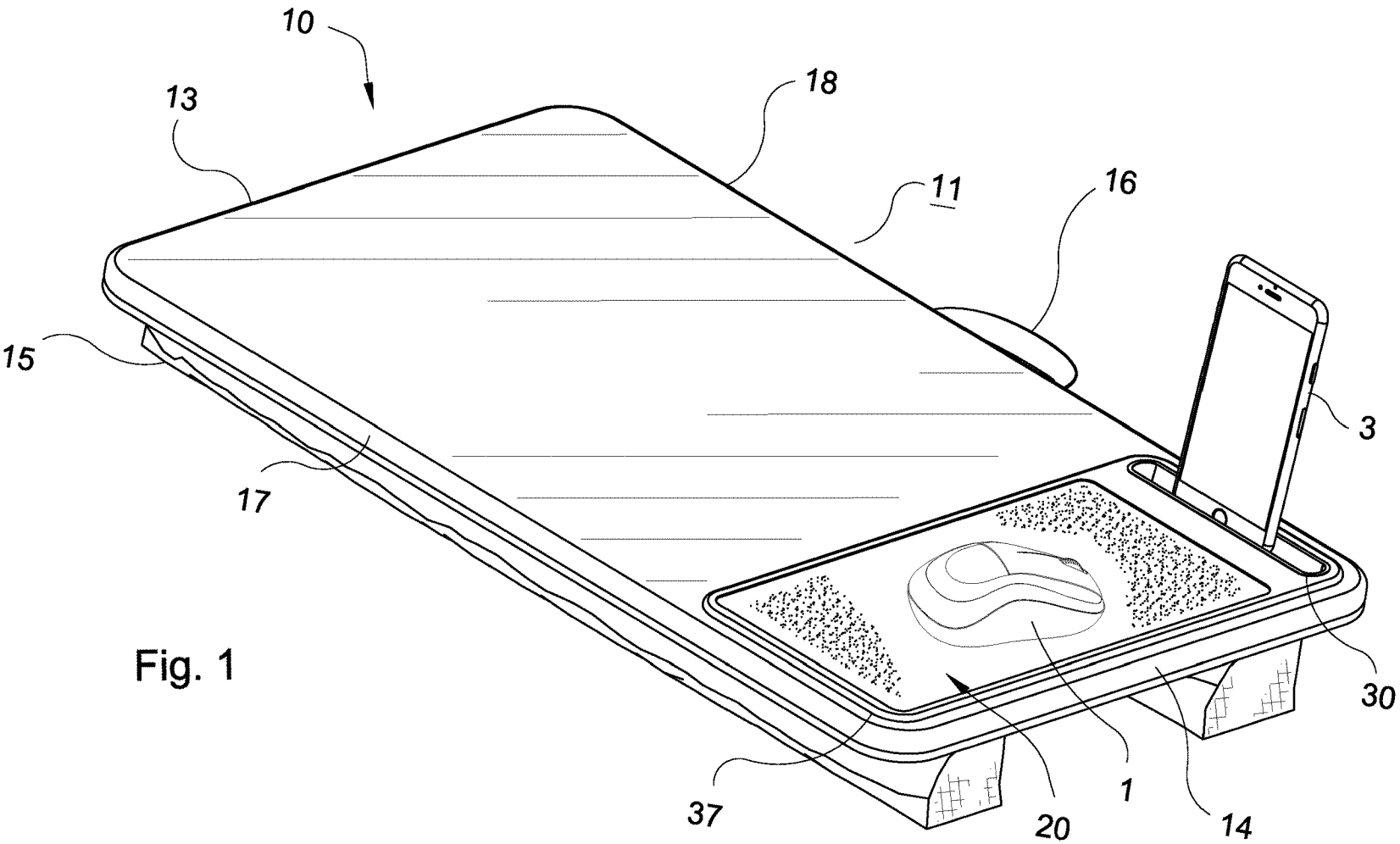
FIG. 1 is a perspective view of a lap desk with the present invention installed and in use with an electronic device.
Figure 2:
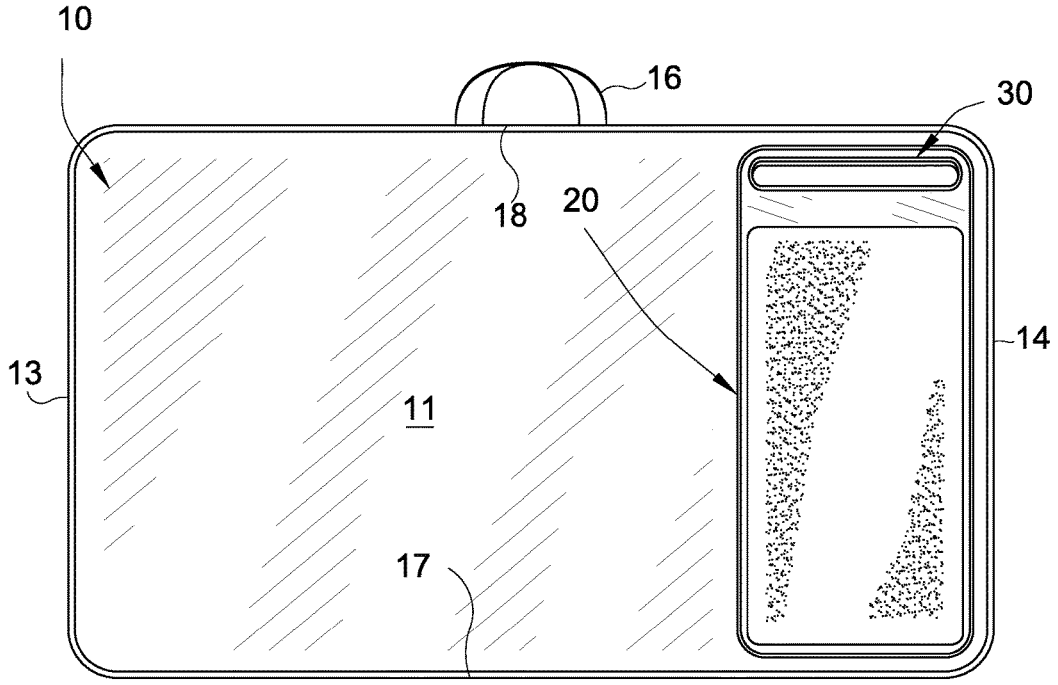
FIGS. 2 & 3 show top and bottom plan views, respectively, of the lap desk embodying the present invention.
Figure 3:
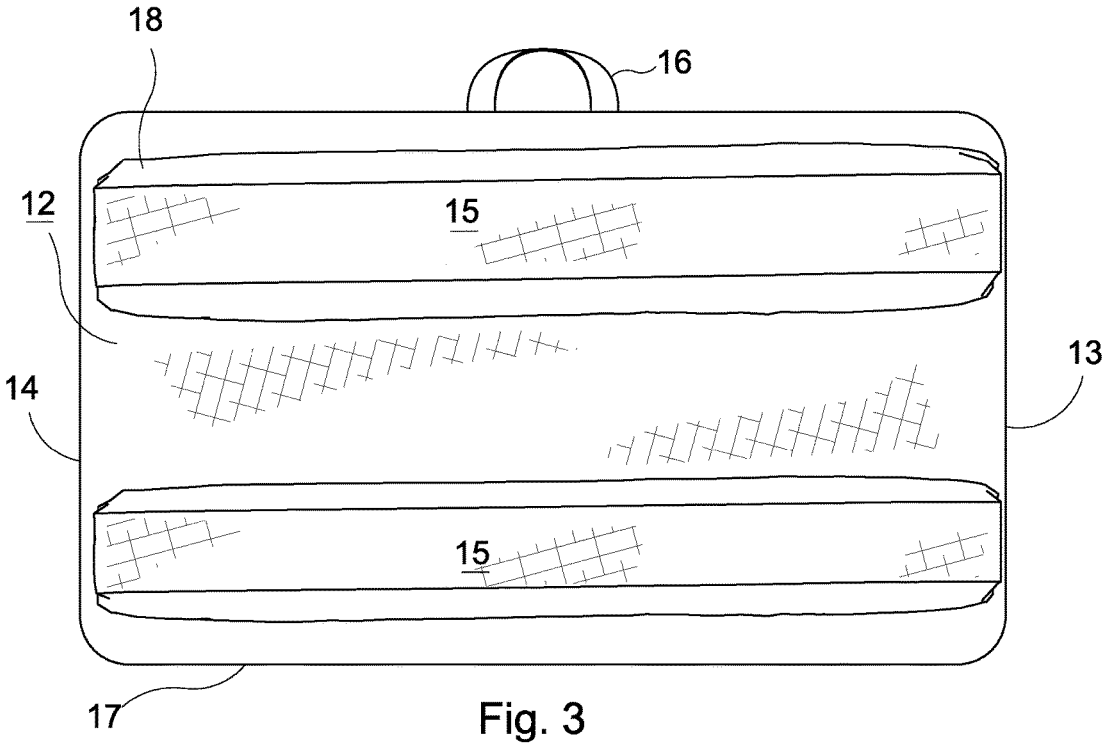
Figure 4:
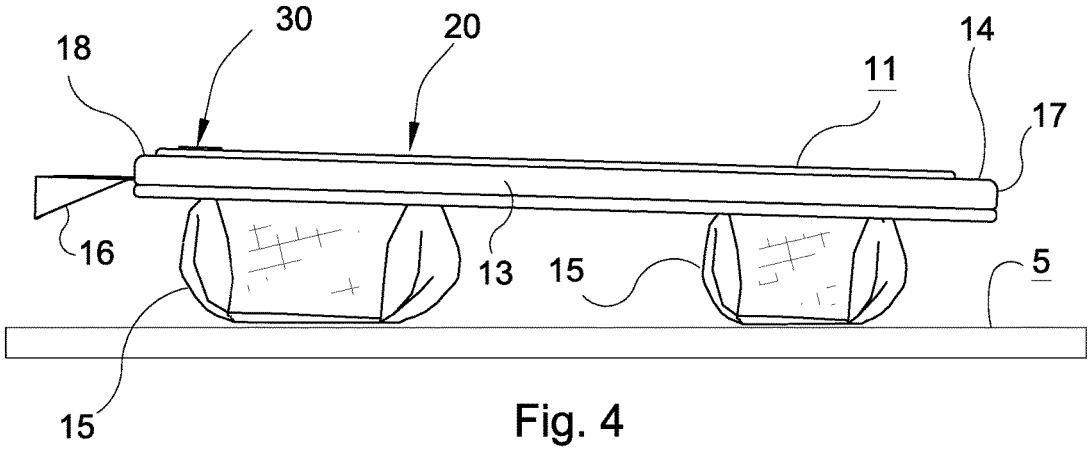
FIGS. 4 & 5 show a right side and rear elevations, respectively, of the lap desk embodying the present invention.
Figure 5:
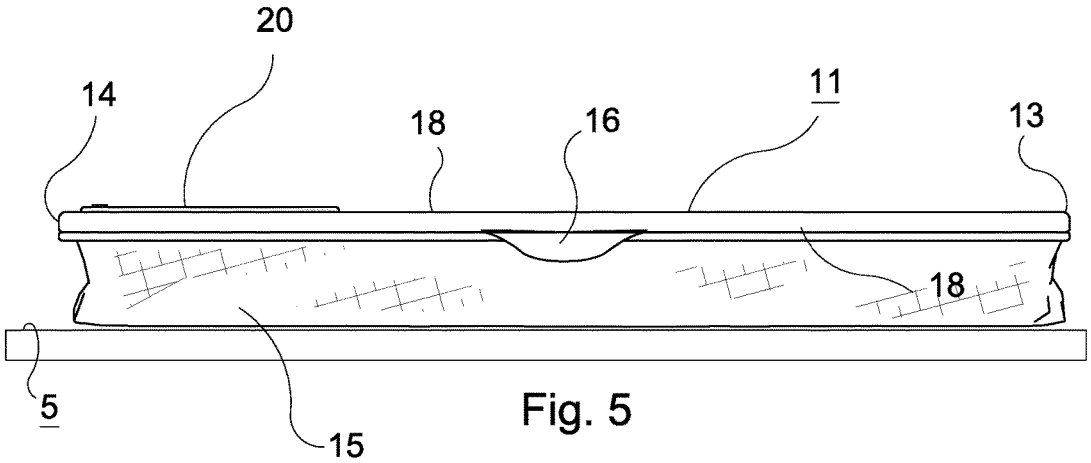

Referring now to the figures, and particularly to FIGS. 1-5, a particular embodiment of the present invention comprises lap desk 10 having a substantially rectangular, upper work surface 11 extending between left side 13 and right side 14, and between front edge 17 and rear edge 18. Except as described below, work surface 11 comprises a smooth, hard deck surface adapted to support objects such as books, writing pads and the like, the hard deck surface presenting a reliable backing for single sheets of paper on which a user (not shown) may wish to write. Lap desk 10 may vary in size and therefore amount of usable work space, but preferably includes at least enough real estate to permit placement of one or more writing pads and to span comfortably across a user's legs.

Opposite and co-extensive with top deck work surface 11, deck bottom 12 preferably includes one or more protrusions 15 designed to stabilize lap desk 10 while it rests on a support surface 5 such as a tabletop (FIGS. 4, 5) or a user's lap (not shown). As depicted, protrusions 15 comprise elongate pads having substantially semi-circular cross sections and extending adjacent and parallel transverse edges 17, 18. Protrusion 15 adjacent front edge 17 preferably is slightly smaller to cause work surface 11 to tilt toward a user addressing lap desk 10 from a position juxtaposed front edge 17. Preferably, protrusions 15 comprise padding to optimize user comfort when lap desk 10 in held in the user's lap. One having ordinary skill in the art will recognize that protrusions 15 may vary considerably in their number, placement and configuration, or may be absent altogether, without departing from the spirit and scope of the present invention.

Turning now also to FIGS. 6-11, integral mouse pad 20 appears adjacent right side 14 and extending substantially between front edge 17 and rear edge 18 of work surface 11. Mouse pad 20 comprises a substantially rectangular region of work surface 11 itself extending between lower margin 21 adjacent front edge 17 and upper margin 22 near but not quite adjacent rear edge 18. As best seen in FIGS. 1, 7 & 9-11, mouse pad 20 preferably is large enough to provide the requisite freedom of horizontal movement for mouse 1 around lap desk 10 as normally is needed for use of mouse 1 as a pointing device for a laptop computer (not shown). Preferably, mouse pad 20 is approximately six (6 in.) inches wide along transverse, lower edge 17 and ten (10 in.) inches long along right side 14, but one having ordinary skill in the art will recognize that any shape or size of mouse pad 20 capable of engaging and operating mouse 1 is considered to be within the spirit and scope of the present invention.

Surface 23 of mouse pad 20 comprises a material having sufficient roughness to provide a roller ball mouse 1 with enough friction to operate efficiently. Further, surface 23 preferably is opaque and absorbent of most laser light frequencies to a degree to provide a laser mouse 1 with the necessary reflection to operate efficiently, but absorbent enough in the relevant light frequencies to dampen unnecessary light backscatter. A suitable material for surface 23 is a rough molded polyethylene available commonly. One having ordinary skill in the art will recognize that surface 23 could be rubber, cloth, a rough paint, or any other material having a rough enough texture and opacity for operating mouse 1 of either design.

Referring now specifically to FIGS. 6-9, slotted device port 30 is disposed between an upper margin of mouse pad 20 and rear edge 18 of work surface 11, and extends substantially the transverse width of mouse pad 20. Preferably, slotted port 30 comprises an integral portion of the casing for mouse pad 20 and both may be molded and manufactured together as a single object, or module 40 (see FIGS. 10, 11). Flange 37 laps over work surface 11 sufficiently to hold mouse pad 20 and device port 30 in place and flush therewith. Further, one having ordinary skill in the art will recognize that module 40 could be used to modify any work surface 11, whether a lap desk 10 or other deck intended to serve as work surface 11, without departing from the spirit and scope of the present invention.

Figure 7:
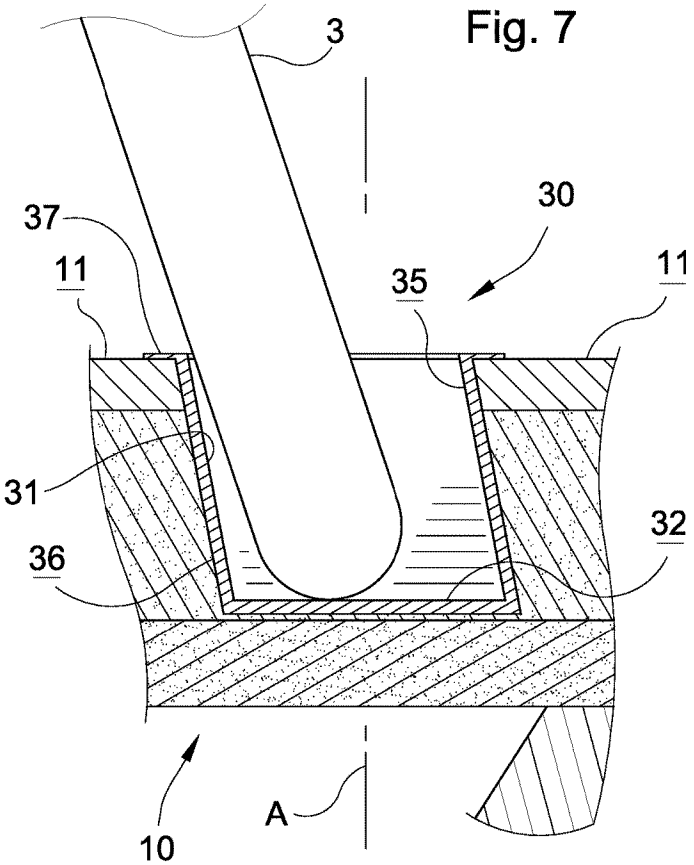
FIG. 7 shows a section, as indicated in FIG. 6, of the electronic device journaled within the slotted port of the present invention.
Figure 6:
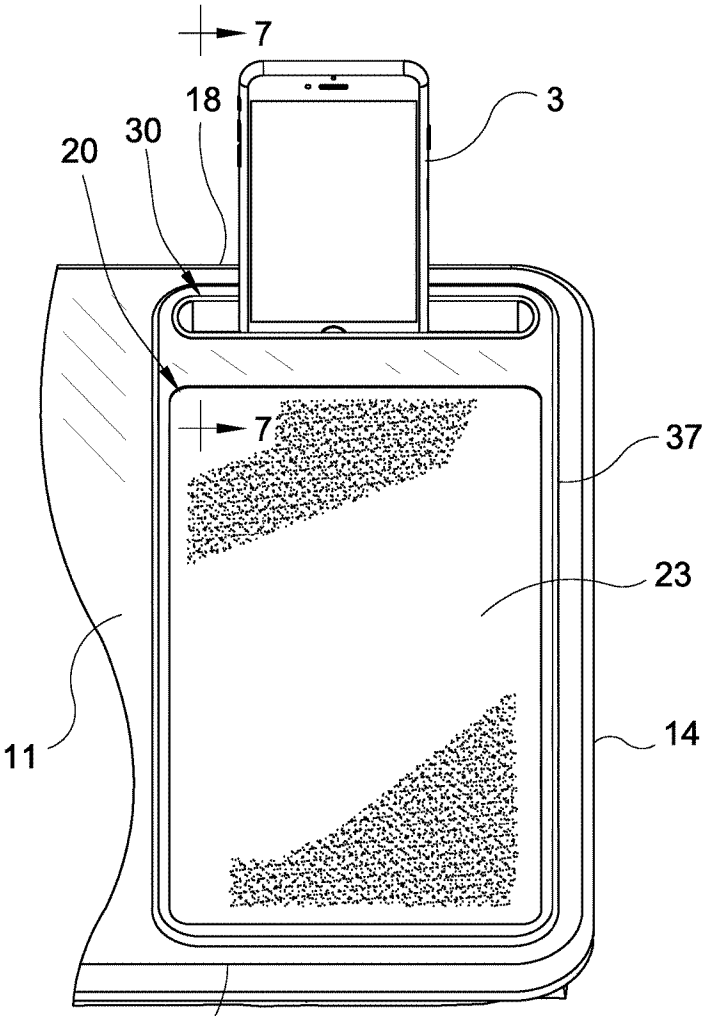
FIG. 6 details the present invention in place on one side of a lap desk, with an electronic device journaled within its device port.
Figure 8:
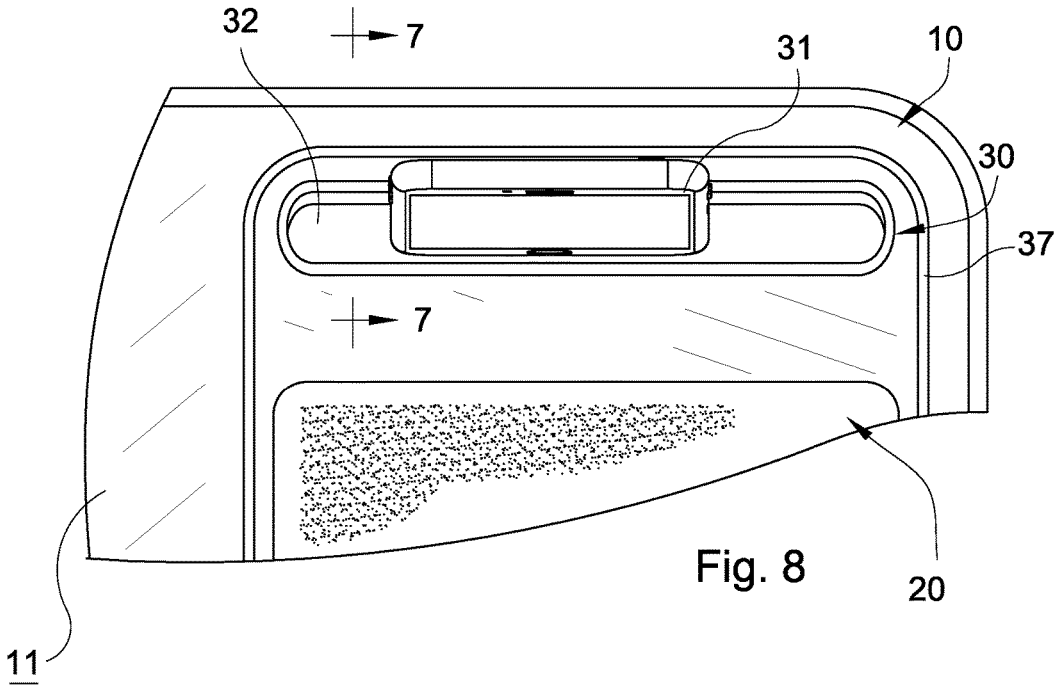
FIGS. 8 & 9 detail in perspectives the present invention installed and in use on a lap desk
Figure 9:
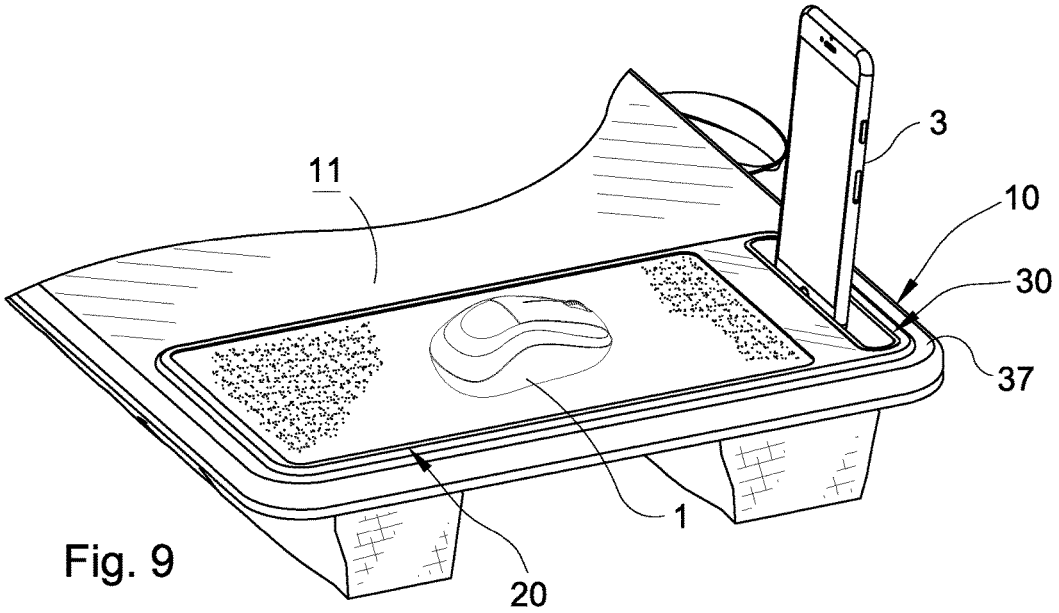
Figure 10:
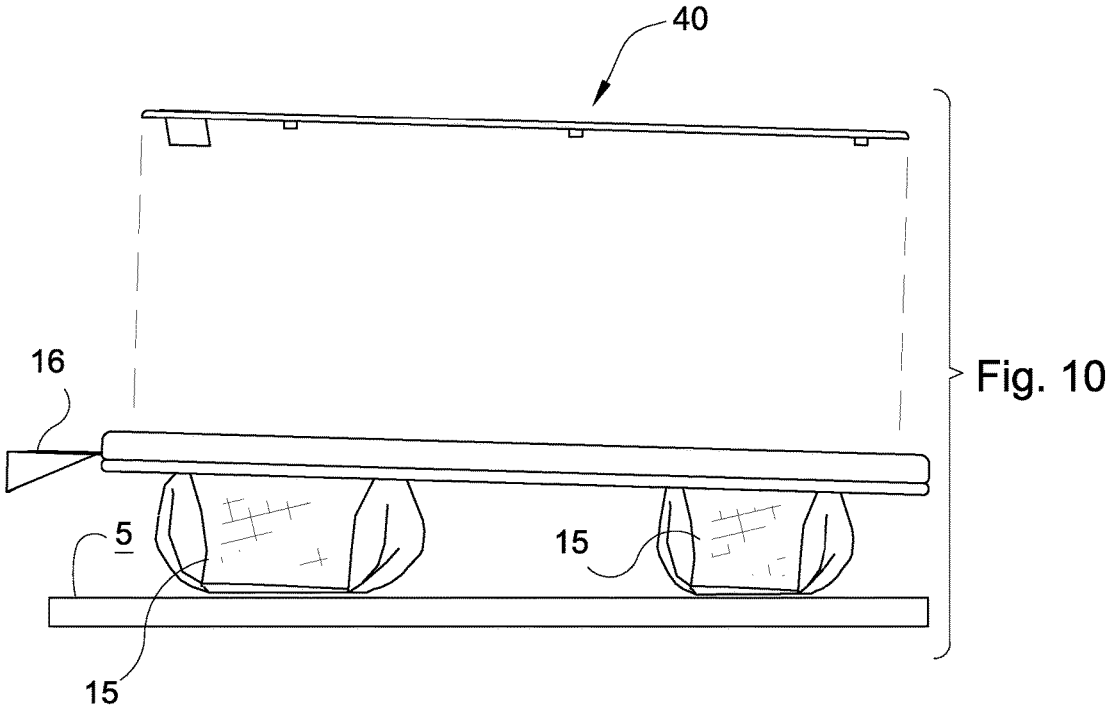
FIGS. 10 & 11 show in exploded views how the present invention mates with a work surface to become an integral part thereof.
Figure 11:
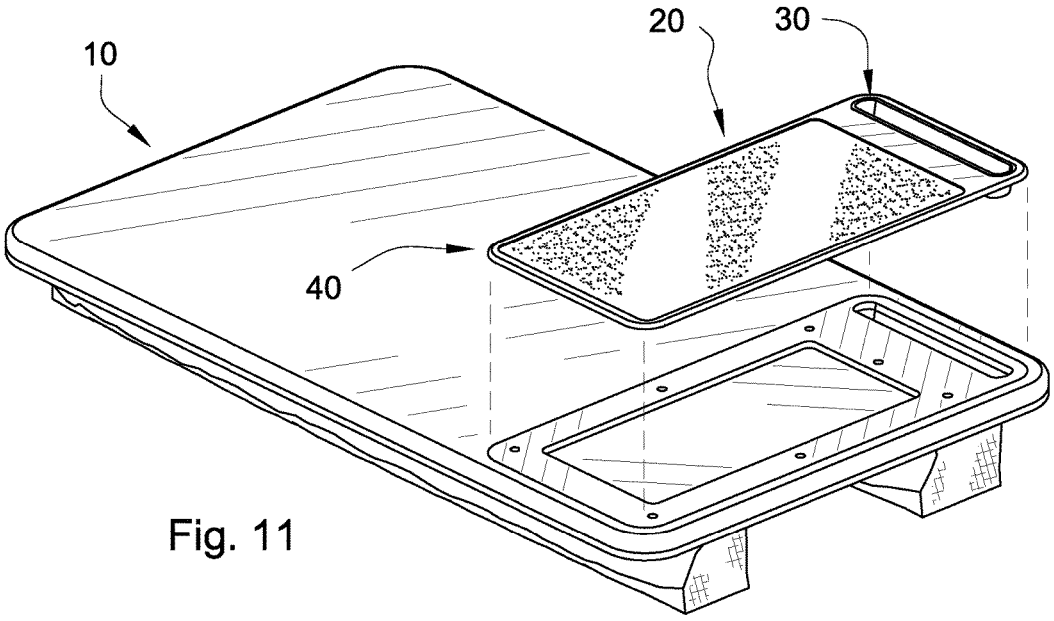

As best seen in FIGS. 7-9, slotted port 30 is embedded within lap desk 10 approximately as deeply (from mouth 31 to bottom 32) as its width (from front wall 35 to rear wall 36). When journaled within slotted port 30, device 3 substantially fills the width of port 30, but not so snugly that it is difficult to insert or withdraw. Further, because of the rearward slope of front and rear walls 35, 36 of slotted port 30, it holds device 3 at an angle relative to the plane of work surface 11 that causes device 3 to tilt rearward at its top opposite work surface 11, and toward rear edge 18. This optimizes the viewing angle of the screen of device 3 for a user addressing lap desk 10 from front edge 17 while slotted port 30 does not cover much if any of the screen.

Device port 30 extends for its length across the top of mouse pad 20 parallel to rear edge 18 for substantially the entire width of mouse pad 20. The length of slotted port 30 is selected to admit electronic device 3, in this case a cellular telephone, in either an upright or sideways (not shown) orientation. One having ordinary skill in the art will recognize that any length of slotted port 30 sufficient to hold electronic device 3 of a size selected for the application is considered to be within the spirit and scope of the present invention. For example, slotted port 30 depicted in the figures is of sufficient size to hold most cellular telephones and perhaps a small e-reader or tablet. Slotted port 30 could, however, be of a length (not shown) sufficient to hold a full size tablet or e-reader such as an iPad (full size) available from Apple Corporation of Cupertino, Calif. USA.

In operation, a user (not shown) would place lap desk 10 on a support surface or his lap, with front edge 17 adjacent the user and work surface 11 tilted slightly toward the user because of the differential sizes of protrusions 15. The user then would place electronic device 3 within port 30 and turn it on for viewing its screen and for manipulation and operation thereof as desired. The user also would place whatever objects desired upon the remainder of work surface 11 and proceed to use them. If those objects include a laptop computer (not shown), the user may connect mouse 1 thereto and place mouse 1 on mouse pad 20 for control of said laptop computer. The user would reverse the foregoing steps, though not necessarily in order, to complete the operation.

While the invention has been particularly shown and described with reference to preferred and alternate embodiments, it will be understood by those skilled in the art that various changes in form and detail may be made therein without departing from the spirit and scope of the invention. For example, as discussed and illustrated, slotted port 30 forms an integral part of an insert that includes mouse pad 20, but slotted port 30 instead could be a separate component and feature of lap desk 10 and disposed at any location within the delimited region of work surface 11. Further, though depicted and described with only one mouse pad 20 and slotted port 30, selected and positioned for left- or right-handed users, lap desk 10 could include both, including duplicate ports 30 associated with each mouse pad 20.

I claim:

1. An improved lap desk, the lap desk having opposing left and right side edges and opposing front rear edges substantially transverse said left and right side edges, said front and rear edges and said left and right side edge together surrounding and defining a substantially planar deck having a top deck surface and an opposite bottom deck surface, the improvement comprising a substantially vertical channel surrounded and defined by said deck, said vertical channel extending and communicating between said top deck surface and said bottom deck surface, said vertical channel having a vertical channel axis normal to said top deck surface;

a device port journaled within said vertical channel, said device port having a device port bottom disposed a spaced distance below and substantially parallel to said planar deck;

front, back, left and right device port walls extending between said device port bottom and said top deck surface through said vertical channel, said device port walls forming a device port upper rim disposed substantially flush with said top deck surface; and a device port flange surrounding and extending radially outward from said device port upper rim a spaced distance, said device port flange being disposed above and in contact with said top deck surface a mouse pad disposed substantially flush with said top deck surface and adjacent said front device port wall, said mouse pad extending toward said front edge from said device port upper rim and having a mouse pad length substantially parallel one of said left and right side edges and a mouse pad width substantially parallel one of said front and rear edges; wherein said device port flange surrounds said mouse pad.

2. The improved lap desk of claim 1 wherein said front and back device port walls are inclined relative to said vertical channel axis to cause said device port bottom to be disposed a spaced distance toward said front edge from said vertical channel axis.

3. The improved lap desk of claim 1 wherein said device port is disposed adjacent to said rear edge.

4. The improved lap desk of claim 1 wherein said mouse pad and said device port are disposed adjacent one of said left and right side edges.

5. The improved lap desk of claim 1 wherein said device port and said mouse pad extend substantially a length of one of said right and left side edges.

6. A personal reading device support system comprising a lap desk having left and right side edges, front and rear edges substantially transverse said left and right side edges, said left and right side edges and said front and back edges surrounding and defining a deck having a deck work surface, said deck surrounding and defining a substantially vertical channel having a vertical channel axis normal to said deck work surface;

a device port journaled within said vertical channel, said device port adapted to receive and support said personal reading device, said device port having a device port bottom disposed a spaced distance below and substantially parallel to said deck work surface;

front, back, left and right device port walls extending between said device port bottom and said deck work surface through said vertical channel, said device port walls forming a device port upper rim disposed substantially flush with said deck work surface; and a device port flange surrounding and extending radially outward from said device port upper rim a spaced distance above and in contact with said deck work surface; and a mouse pad disposed substantially flush with said deck work surface and adjacent said front device port wall wherein said device port flange surrounds said mouse pad.

7. The personal reading device support system of claim 6 wherein said mouse pad and said device port are disposed adjacent one of said left and right side edges.

8. The personal reading device support system of claim 6 wherein said device port and said mouse pad extend substantially a length of said one of said left and right side edges between said front edge and said rear edge.

9. The personal reading device support system of claim 6 wherein said device port is disposed between said mouse pad and said rear edge.

10. The personal reading device support system of claim 6 wherein said front and back device port walls are inclined relative to said vertical channel axis to cause said device port bottom to be disposed a spaced distance toward said front edge from said vertical channel axis.

11. An electronic device support module adapted to improve a work deck, the work deck having a perimeter surrounding and defining a work deck top surface, said work deck further surrounding and defining a vertical channel having a vertical channel axis normal to said work deck top surface, said electronic device support module, comprising a device port adapted to admit and support said electronic device, said device port adapted to journal within said vertical channel and surrounding said vertical channel axis, said device port having a device port bottom adapted to be disposed a spaced distance below and substantially parallel to said work deck top surface;

front, back, left and right device port walls adapted to extend between said device port bottom and said work deck top surface through said vertical channel, said device port walls forming a device port upper rim disposed substantially flush with said work deck top surface; and a device port flange adapted to surround and extend radially outward from said device port upper rim a spaced distance above and in contact with said work deck top surface; and a mouse pad integral with said module, said mouse pad disposed adjacent said front device port wall and adapted to extend away from said device port atop said work deck top surface, and wherein said device port flange surrounds said mouse pad.

12. The personal reading device support system of claim 11 wherein said front and back device port walls are inclined relative to said vertical channel axis to cause said device port bottom to be disposed a spaced distance away from said vertical channel axis.

* * * * *